US005395510A

United States Patent [19]

Kikuchi et al.

[11] Patent Number: 5,395,510

[45] Date of Patent: Mar. 7, 1995

[54] EFFICIENT PREPARATION OF BLACKENED STEEL STRIP

[75] Inventors: Katsuhei Kikuchi; Sachiko Suzuki; Nobuo Totsuka; Takao Kurisu; Keizo Okuno; Yoshihiro Naruse, all of Chiba, Japan

[73] Assignee: Kawasaki Steel Corporation, Kobe, Japan

[21] Appl. No.: 124,759

[22] Filed: Sep. 22, 1993

[51] Int. Cl.[6] ..... C25D 1/04

[52] U.S. Cl. ..... 205/138; 205/152; 205/199; 205/217; 205/219; 205/320

[58] Field of Search ..... 205/217, 219, 138, 152, 205/199, 220

[56] References Cited

U.S. PATENT DOCUMENTS 4,637,840 1/1987 Fujii et al. ..... 148/6.2
4,861,441 8/1989 Saito et al. ..... 204/38.7

FOREIGN PATENT DOCUMENTS 143594 7/1986 Japan .
61-143594 7/1986 Japan .
4-143293 5/1992 Japan .

*Primary Examiner*—John Niebling
*Assistant Examiner*—Edna Wong
*Attorney, Agent, or Firm*—Staas & Halsey

[57] ABSTRACT

A blackened steel strip having improved blackness is produced in an efficient manner by anodizing a zinc alloy-plated steel strip in a solution containing 5 to 100 g/l of $ClO_3^-$ and 10 to 300 g/l of $SO_4^{2-}$ at pH 0.5 to 2.5 at a temperature of 30° to 75° C. and with a quantity of electricity of 10 to 300 C/dm$^2$, and forming an acrylic resin chromate layer on the anodized steel strip to a thickness of 0.3 to 2.5 μm. The solution may contain 5 to 100 g/l in total of at least one co-additive selected from $Cl^-$, $NO_3^-$, $H_2O_2$, $Ni^{2+}$, $Co^{2+}$, $Fe^{2+}$, and $Mn^{2+}$. The acrylic resin chromate layer contains 2 to 10 parts by weight of in the form of a chromate Cr per 100 parts by weight of acrylic resin.

4 Claims, 1 Drawing Sheet

EFFICIENT PREPARATION OF BLACKENED STEEL STRIP

BACKGROUND OF THE INVENTION

1. Field of the Invention

This invention relates to a method for preparing blackened steel strips or sheets having a blackened layer of even outer appearance for use in buildings, electric appliances and automobiles.

2. Prior Art

At present, steel strips having a blackened surface are widely used in electric appliances, copying machines, information communications machines, automotive parts, building interior members and the like. Such blackened steel strips are manufactured by various techniques including (1) black paint coating, (2) chemical treatment, (3) blackening chromate treatment, (4) anodic treatment, and (5) cathodic treatment. Most industrial among others is the anodic treatment as disclosed in Japanese Patent Publication (JP-B) Nos. 60915/1986, 46158/1988, and 46159/1988.

The anodic treatment is to accomplish coloring by plating a zinc alloy layer on a steel strip and dissolving some of the alloy components from the plating layer into an electrolytic solution. The anodic treatment is thus industrially disadvantageous in this regard as compared with the cathodic treatment, but has advantages of quality including tight adhesion and uniform outer appearance over the remaining techniques. We previously proposed in Japanese Patent Application Kokai (JP-A) No. 143293/1992 a new method for preparing a colored steel strip in order to produce a blackened steel strip having a uniform color layer independent of the underlying plating layer.

Starting production of colored steel strips on a commercial scale, we encountered several problems including (1) generation of metal hydroxides such as zinc hydroxide during the process, (2) dropping of any deposit from the cathode, and (3) occurrence of spark marks.

As the production quantity increases, zinc accumulates in the electrolytic solution due to anodic treatment. Since the electrolytic solution is increased in pH near the cathode due to hydrogen generation, pH adjustment is necessary on the cathode side. In practice, the electrolytic solution is pH adjusted when it is fed from the electrolytic tank back to the circulation tank. Due to this time lag, the solution in the electrolytic tank is at higher pH than in the circulation tank. Then, as zinc accumulates, zinc forms a hydroxide due to a pH rise in the electrolytic tank. This zinc hydroxide does not disappear, but is suspended in the solution and deposits on the conveyor rolls where such deposits can be caught by the strip moving along the rolls, causing defects and damages to the strip. At the same time, alloy components adhering to the cathode without being completely reduced to metallic state can be stripped therefrom and deposited on the conveyor rolls where such deposits cause damage to the steel strip.

A horizontal electrolytic tank is designed such that electricity is conducted to a steel strip via conductor rolls located at the inlet and outlet. However, if electric conduction is performed at both the inlet and outlet during blackening process, small defects having metallic luster are formed on the strip surface near the outlet due to spark marks. If whole electric current is introduced at the inlet conductor roll, Joule's heat generates to heat the steel strip especially when it is thin and at the same time, increases the temperature of the electrolytic solution, adversely affecting the black outer appearance of the strip. In order to continue production while keeping the black outer appearance satisfactory, the production rate must be reduced to one-half of the system capacity.

To ensure consistent production of blackened steel strips of quality, there are employed countermeasures that (1) the electrolytic solution is replaced by a fresh one when the zinc concentration in the solution exceeds a predetermined level, (2) the electrode is taken out, polished and cleaned after a predetermined quantity of steel is treated, and (3) operation is continued at a production rate reduced to one-half of the system capacity. These countermeasures have the drawbacks of an increased downtime, reduced operation rate, and reduced production efficiency.

Such problems might be overcome by providing (1) zinc removal means or (2) an additional electrolytic tank at the sacrifice of economy. That is, capital investment is increased. The latter (2), which is proposed in JP-A 17695/1992, is difficult in maintenance and control since acid or alkali is sprayed to the conduction rolls to indirectly accomplish surface treatment of a steel strip. The strip is liable to variations in a transverse direction due to decoloring.

As previously described, generation of hydrogen gas on the cathode side causes the electrolytic solution to increase its pH so that zinc being dissolved out may form a hydroxide which is suspended in the electrolytic solution and seized by the rolls as foreign matter, causing defects. Such problems may be solved by lowering the pH of the electrolytic solution. However, since a pH lowering allows for etching, electrolysis at such low pH results in a steel strip having increased surface roughness and losing luster. Etching also increases factors of detracting from outer appearance as by removing some of the blackened layer to cause decoloring thereof and incurring non-uniform outer appearance in a transverse direction. It was difficult to solve these problems.

SUMMARY OF THE INVENTION

Therefore, an object of the present invention is to provide a method for preparing a blackened steel strip of at least equivalent quality to conventional ones by anodizing a zinc alloy-plated steel strip in an electrolytic solution, which by lowering the pH of the solution, increases the production rate, reduces plating defect-causing factors resulting from metal hydroxides and spark marks which would otherwise occur during electrolysis, and significantly reduces the electrical power consumption, and which by overlying a resin chromate layer, compensates for the tendency of low pH solution to aggravate the surface appearance.

According to the invention, there is provided a method for preparing a blackened steel strip in an efficient manner, comprising the steps of: anodizing a zinc alloy-plated steel strip in a solution containing 5 to 100 g/l of chlorate ion ($ClO_3^-$) and 10 to 300 g/l of sulfate ion ($SO_4^{2-}$) at pH 0.5 to 2.5 at a temperature of 30° to 75° C. and with a quantity of electricity of 10 to 300 coulomb/dm$^2$, and forming an acrylic resin chromate layer on the anodized steel strip to a thickness of 0.3 to 2.5 μm. Preferably the solution contains 5 to 100 g/l in total of at least one member selected from the group consisting of $Cl^-$, $NO_3^-$, $H_2O_2$, $Ni^{2+}$, $Co^{2+}$, $Fe^{2+}$, and $Mn^{2+}$ as a co-additive. The acrylic resin chromate layer desirably contains 100 parts by weight of an acrylic resin and 2 to 10 parts by weight of chromium in a form of chromate on a dry base.

The present invention accounts for an increase of outer appearance disturbing factors by a pH lowering and intends to find a way to solve productivity problems. More particularly, a pH lowering can exacerbate surface roughness and luster which variations are later reflected by complaints from the user. The manufacturer will be accused of its responsibility to supply products of consistent quality. However, the manufacturer must utilize the production capacity of the system to a full extent partially for cost reduction. In this regard, we have found that the outer appearance problem associated with a pH lowering can be overcome by forming a resin chromate layer on an anodized steel strip, marking a great advance.

DETAILED DESCRIPTION OF THE INVENTION

According to the invention, a blackened steel strip is prepared by anodizing a zinc alloy-plated steel strip in an electrolytic solution and then forming a resin chromate layer on the anodized strip. The zinc alloy platings used herein include binary alloy platings such as Zn-Ni, Zn-Fe, Zn-Co, Zn-Mn, and ternary alloy platings such as Zn-Ni-Co, Zn-Ni-Fe, Zn-Co-Fe, Zn-Fe-P, and Zn-Ni-P.

The zinc alloy-plated steel strip is immersed in an electrolytic solution for anodic treatment. The solution contains 5 to 100 g/l of chlorate ion ($ClO_3^-$) and 10 to 300 g/l of sulfate ion ($SO_4^{2-}$) and is at pH 0.5 to 2.5. Electrolytic conditions include a temperature of 30° to 75° C. and an quantity of electricity of 10 to 300 coulomb/dm$^2$. Preferably the solution contains 5 to 100 g/l in total of at least one co-additive selected from the group consisting of $Cl^-$, $NO_3^-$, $H_2O_2$, $Ni^{2+}$, $Co^{2+}$, $Fe^{2+}$, and $Mn^{2+}$.

On the steel strip which is blackened by anodic electrolysis is formed an acrylic resin chromate layer. The resin chromate layer has a thickness of 0.3 to 2.5 μm and preferably contains 2 to 10 parts by weight of chromium in a form of chromate per 100 parts by weight of acrylic resin.

The acrylic resin chromate layer used herein is formed, for example, by mixing an aqueous dispersion of an acrylic resin and an aqueous solution of chromic acid, and applying the resulting aqueous dispersion to the steel strip, followed by drying.

Described below is the reason of limitation of the respective components of the invention.

The electrolytic solution for anodic treatment contains 5 to 100 g/l of chlorate ion ($ClO_3^-$) and 10 to 300 g/l of sulfate ion ($SO_4^{2-}$) and is at pH 0.5 to 2.5. Less than 5 g/l of chlorate ion contributes to little blackening whereas more than 100 g/l of chlorate ion is uneconomical because the continuous processing of steel strip entails a substantial drag-out (carry-over of the active solution by the steel strip). If a halogenic acid salt is the chlorate ion source, one or more elements of Na, K, $NH_4$, Ca and Mg may be used without affecting blackening, with the sodium salt being preferred because of increased solubility and low cost.

Sulfate ion ($SO_4^{2-}$) is contained in an amount of 10 to 300 g/l for promoting dissolving of the zinc alloy plating, especially for facilitating dissolving of alloying components necessary for blackening, such as Ni, Co, Fe and Mn. Less than 10 g/l of sulfate ion is not effective for dissolution and pH buffering, allowing substantial pH variations. More than 300 g/l of sulfate ion is uneconomical because of a substantial drag-out associated with the continuous processing of steel strip and can cause clogging of plumbing at low temperatures as encountered in winter. The sulfate ion source includes $Na_2SO_4$, $K_2SO_4$, $(NH_4)_2SO_4$, $CaSO_4$, and $MgSO_4$, all having increased solubility.

Figure 1:
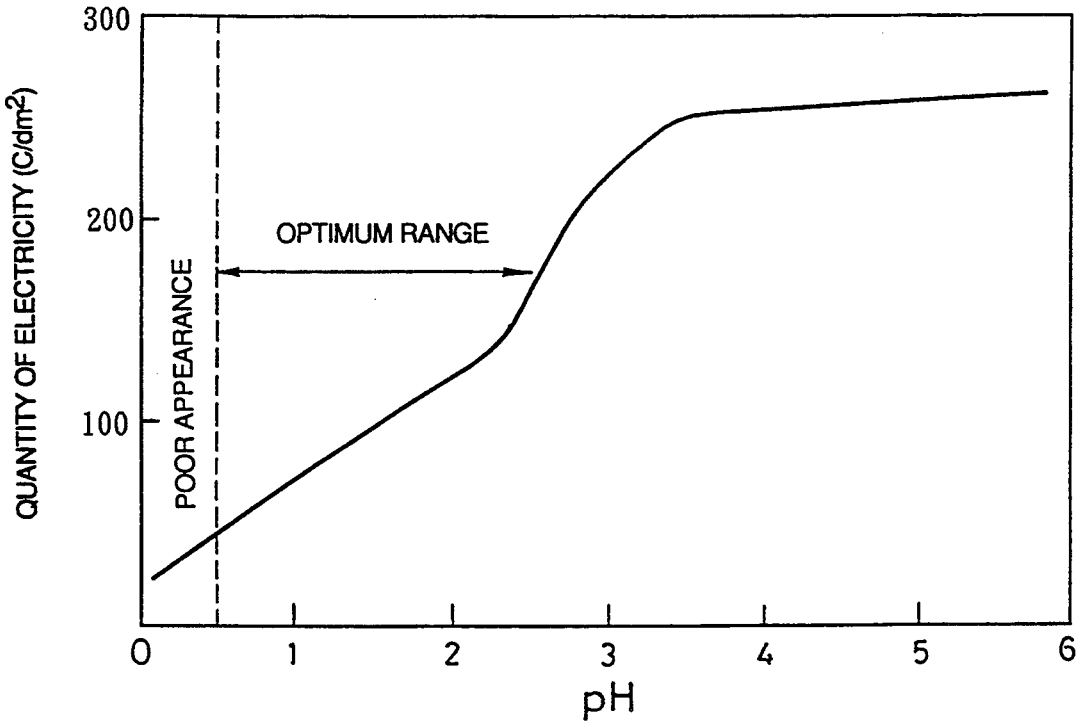
FIG 1 is a diagram showing the electricity quantity versus pH of electrolytic solution required to provide a blackened surface with an equal outer appearance.

The pH range is 0.5 to 2.5, preferably 1 to 2.0. Below pH 0.5, acidic etching becomes enhanced and proceeds beyond the necessary extent, resulting in uneven coloring which cannot be repaired by an overlying resin chromate layer. An experiment was carried out by using a zinc alloy-plated steel strip having Zn-12 wt % Ni plating and an electrolytic solution containing 50 g/l of $ClO_3^-$ and 100 g/l of $SO_4^{2-}$ at a temperature of 50° C. and conducting electricity to perform anodic treatment on the strip. The pH of the solution was varied from approximately 0 to approximately 6. Determined was the quantity of electricity (C/dm$^2$) required to provide a blackened surface with an equal outer appearance, which was quantitatively determined as an L value. The results are shown in FIG. 1. It is evident from FIG. 1 that above pH 2.5, the quantity of electricity required to provide an equal L value dramatically increases, detracting from productivity. Differently stated, at lower pH, only a smaller quantity of electricity may be conducted to provide the same outer appearance so that the production rate may be increased in inverse proportion to the quantity of electricity. This is because above pH 2.5, etching action to dissolve zinc is extremely reduced and instead, electrolytic dissolution becomes predominant.

Figure 2:
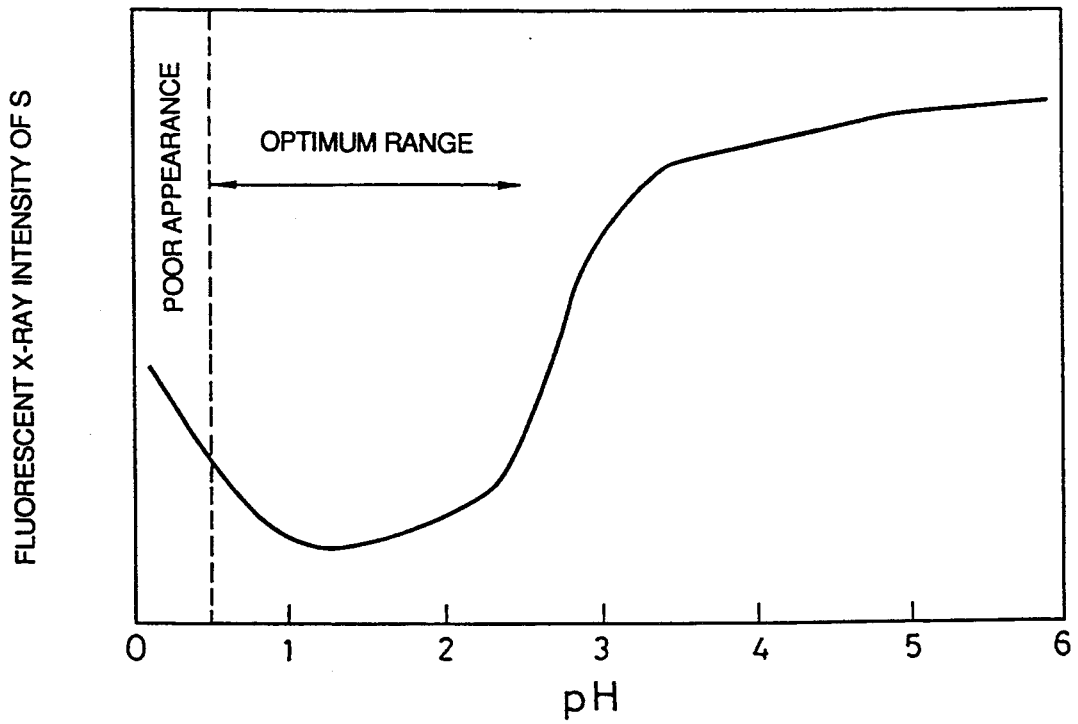
FIG. 2 is a diagram showing the amount of composite sulfate compound formed on a blackened coating versus pH of electrolytic solution.

On the surface having undergone blackening treatment is formed a composite compound layer consisting of sulfates and hydroxides of zinc and alloying components. If this composite compound layer is thick enough to provide a white appearance, the black coating is negated. The composite compound is an electrical insulator and thus causes occurrence of spark marks. Another experiment was carried out by using a zinc alloy-plated steel strip having Zn-12 wt % Ni plating and an electrolytic solution containing 50 g/l of $ClO_3^-$ and 100 g/l of $SO_4^{2-}$ at a temperature of 50° C. and conducting 100 C/dm$^2$ of quantity of electricity to perform anodic treatment on the strip. The pH of the solution was varied from approximately 0 to approximately 6. There was formed a composite metal compound $(Zn,Ni).(SO_4)_x.(OH)_y.zH_2O$ on the surface. The quantity of sulfur (S) in the composite metal compound was determined by fluorescent X-ray analysis. The results are shown in FIG. 2. It is evident from FIG. 2 that with the quantity of electricity fixed, the quantity of sulfur is smaller at lower pH. By maintaining the electrolytic solution at pH 2.5 or lower, especially at pH 2.0 or lower, the amount of composite metal compound deposited on the steel strip surface is reduced for eliminating the occurrence of spark marks at the electrolytic tank outlet. This enables electric conduction at both the inlet and outlet of the electrolytic tank, leading to a substantial increase of production rate.

For pH control, there may be used any desired acid, for example, mineral acids such as $H_2SO_4$, HCl, $HNO_3$ and $HClO_3$ and halogenic acids. The pH control means is not limited thereto insofar as the objects of the invention are attained.

In addition to the chlorate and sulfate ions, the electrolytic solution for anodic treatment may further contain one or more co-additives of $Cl^-$, $NO_3^-$, $H_2O_2$, $Ni^{2+}$, $Co^{2+}$, $Fe^{2+}$, and $Mn^{2+}$, more preferably one or more co-additives of $H_2O_2$, $Ni^{2+}$, $Co^{2+}$, $Fe^{2+}$, and $Mn^{2+}$, in a total amount of 5 to 100 g/l because such co-additives are effective for increasing blackness. Less than 5 g/l of the co-additive contributes to little blackening whereas more than 100 g/l of the co-additive is uneconomical because of a substantial drag-out associated with the continuous processing of steel strip and rather reduces its contribution to blackening, resulting in increased L values. The reason why these co-additives are effective for improving blackness is that they assist in dissolving the zinc alloy plating layer as Zn and Ni, Co, Fe or Mn ions and supply metal ions necessary for a blackened layer to the interface of steel strip being blackened. The sources of $Cl^-$ and $NO_3^-$ include corresponding acids and sodium, potassium and ammonium salts thereof though the source not limited to these examples The sources of $Ni^{2+}$, $Co^{2+}$, $Fe^{2+}$, and $Mn^{2+}$ include sulfates, chlorides and nitrates of these cations though the source is not limited to these examples.

Among zinc alloy-plated steel strips, Zn-Ni alloy-plated steel strips are adequate low-cost stock strips because they are commercially manufactured in large supply and have consistent quality. The nickel content is in the range of 10 to 15% by weight in the case of automotive strips. Since this range of nickel content ensures corrosion resistance, plating adhesion and workability, these zinc-nickel alloy-plated steel strips are adequate strips which are intended for blackening treatment. Also useful are Zn-Fe, Zn-Co and Zn-Mn alloy-plated steel strips.

On anodic treatment, the optimum quantity of electricity must be empirically determined relative to the weight of the underlying plating. For ordinary Zn-Ni alloy-plated steel strips which are commercially manufactured for automotive applications and have a coating weight of 20 to 40 g/m$^2$ on each strip surface, the optimum quantity of electricity is 10 to 300 C/dm$^2$. Less than 10 C/dm$^2$ of quantity of electricity brings out little change of L value from the stock strip. More than 300 C/dm$^2$ of quantity of electricity will aggravate plating adhesion and hence quality because the residual Zn-Ni alloy plating layer becomes too thin. Zn-Ni alloy-plated steel strips having a coating weight of more than 40 g/m$^2$ can also be treated in a partially overlapping quantity of electricity range although such heavy coating is not recommended because of an increased cost. The situation is the same for other zinc alloy-plated steel strips. For any type of plating, the optimum quantity of electricity may be determined without undue experimentation.

As previously mentioned, electrolysis at lower pH rather promotes etching, resulting in increased surface roughness and a loss of luster. With an L value=10 and a number of samples n=20, a variation of L value was examined to find a variation $\sigma=0.15$ at pH 3.0 and $\sigma=0.27$ at pH 1.5. That is, a lower pH (pH 1.5) tends to develop more color variations to exacerbate the outer appearance. The term "poor appearance" used herein means the occurrence of color variations.

The electrolytic solution is at a temperature of 30° to 75° C., preferably 40° to 60° C. Below 30° C., the solution is too low in reactivity to accomplish sufficient blackening and some ingredients can precipitate therefrom. Above 75° C., the solution becomes too reactive, also failing to produce a coating having satisfactory blackness.

In the prior art, after blackening treatment, a chromate coating is applied for providing corrosion resistance and protecting the outer appearance and a resin is coated thereon. Studying how to repair the outer appearance which is deteriorated by lowering the pH of electrolytic solution, we have found that it is most effective to coat chromate and resin as a single coating. Although the resin which can be stably used as the resin chromate is limited, acrylic resins can form stable aqueous solutions with chromic acid simply by mixing. By overlying an acrylic resin chromate layer, the variation of L value was controlled to a variation $\sigma=0.10$ at pH 3.0 and $\sigma=0.13$ at pH 1.5, that is, controlled to an approximately identical value irrespective of pH. Although the reason is not well understood, we presume that surface irregularities are filled and covered with the resin and chromium in the chromate acts to reduce the L value variation. The acrylic resin chromate layer has a dry thickness of 0.3 to 2.5 μm because a layer thinner than 0.3 μm is not effective for improving the outer appearance whereas a layer thicker than 2.5 μm has an increased surface resistance which is undesirable for welding and electric conduction.

In the acrylic resin chromate layer, the acrylic resin and chromium (Cr) in a form of chromate are preferably contained such that 2 to 10 parts by weight of chromium in a form of chromate is present per 100 parts by weight of acrylic resin. A resin chromate layer containing less than 2 parts of Cr in a form of chromate on this basis would be less effective for reducing the L value variation whereas a resin chromate layer containing more than 10 parts of Cr in a form of chromate would lower electrical insulation and thus adversely affect the spot weldability of the resulting product.

EXAMPLE

Examples of the present invention are given below by way of illustration and not by way of limitation.

Examples

A number of zinc alloy-plated steel strips were subject to anodic treatment in electrolytic baths. The steel strips are shown below.

Zn-Ni alloy plated steel strip (Inventions 1–12, 16, 17 and Comparisons 1–11, 14)
- Coating weight: 20 g/m$^2$
- Nickel content: 12 wt %
- Steel strip: gage 0.7 mm (SPCD)

Zn-Fe alloy plated steel strip (Invention 13 and Comparison 13)
- Coating weight: 20 g/m$^2$
- Iron content: 10 wt %
- Steel strip: gage 0.7 mm (SPCD)

Zn-Co alloy plated steel strip (Invention 14 and Comparison 12)
- Coating weight: 20 g/m$^2$
- Cobalt content: 5 wt %
- Steel strip: gage 0.7 mm (SPCD)

Zn-Mn alloy plated steel strip (Invention 15 and Comparison 15)

Coating weight: 20 g/m$^2$

Manganese content: 10 wt %

Steel strip: gage 0.7 mm (SPCD)

The electrolytic bath composition and conditions are shown in Table 1. Note that sodium sulfate ($Na_2SO_4$) and sulfuric acid ($H_2SO_4$) were used to adjust the amount of $SO_4^{2-}$ and pH.

After the blackening treatment, a resin chromate layer was applied to the blackened surface using an aqueous acrylic resin, Paltop 3966AX+BY commercially available from Nippon Parker K.K. The resin chromate layer had a chromium content of 50±10 mg/m$^2$.

The samples were measured for L value by means of a color computer (manufactured by Suga Tester K.K.). The results are shown in Table 1. It is to be noted that the L value is representative of a lightness in Hunter's uniform color space proposed by R. S. Hunter (1948) based on the CIE colorimetric system. Blackening was regarded satisfactory when the L value was 15 or lower after resin chromate coating.

By lowering the pH of an electrolytic solution for carrying out anodic treatment on a zinc alloy-plated steel strip, the present invention is successful in doubling the production rate, minimizing plating defects due to metal hydroxides and spark marks which would otherwise occur during electrolysis, and reducing the power consumption. By subsequently performing resin chromate treatment, the present invention overcomes the difficulty to compensate for the low pH solution tending to aggravate the surface appearance. There is obtained a blackened steel strip of at least equal quality to conventional ones.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

TABLE 1

| | Anodic treatment | | | | | | Resin chromate layer | | L value | |
|---|---|---|---|---|---|---|---|---|---|---|
| | Bath composition | | | | | | | | | |
| | $ClO_3^-$ (g/l) | $SO_4^{2-}$ ion, co-additive (g/l) | pH | Temp. (°C.) | Current density (A/dm$^2$) | Quantity of electricity (C/dm$^2$) | Dry thickness (μm) | Cr (ppw) | After blackening | After resin chromate coating |
| 1 | 15 | $SO_4^{2-}$ 50 | 1.5 | 50 | 50 | 100 | 1.0 | 5 | 9 | 11 |
| 2 | 50 | $SO_4^{2-}$ 100 | 1.5 | 50 | 75 | 100 | 1.0 | 5 | 8 | 12 |
| 3 | 50 | $SO_4^{2-}$ 200 | 0.5 | 35 | 100 | 20 | 2.5 | 2 | 7 | 12 |
| 4 | 80 | $SO_4^{2-}$ 50 | 2.5 | 50 | 50 | 150 | 1.0 | 5 | 9 | 12 |
| 5 | 50 | $SO_4^{2-}$ 100 | 1.5 | 70 | 30 | 150 | 1.0 | 5 | 9 | 12 |
| 6 | 50 | $SO_4^{2-}$ 100 | 1.7 | 50 | 75 | 120 | 0.3 | 10 | 8 | 12 |
| 7 | 30 | $SO_4^{2-}$ 50<br>$Cl^-$ 50 | 1.5 | 60 | 75 | 100 | 1.0 | 5 | 8 | 11 |
| 8 | 30 | $SO_4^{2-}$ 100<br>$Ni^{2+}$ 20 | 1.5 | 50 | 50 | 100 | 1.0 | 5 | 7 | 10 |
| 9 | 50 | $SO_4^{2-}$ 50<br>$Co^{2+}$ 10 | 1.6 | 60 | 100 | 120 | 1.0 | 5 | 7 | 10 |
| 10 | 50 | $SO_4^{2-}$ 50<br>$Fe^{2+}$ 20 | 1.4 | 50 | 75 | 120 | 1.0 | 5 | 7 | 10 |
| 11 | 30 | $SO_4^{2-}$ 50<br>$Mn^{2+}$ 25 | 1.3 | 50 | 50 | 80 | 1.0 | 5 | 7 | 10 |
| 12 | 25 | $SO_4^{2-}$ 50<br>$H_2O_2$ 30 | 1.5 | 35 | 30 | 100 | 1.0 | 5 | 8 | 11 |
| 13 | 50 | $SO_4^{2-}$ 50<br>$CO^{2+}$ 10 | 1.5 | 60 | 50 | 100 | 1.0 | 5 | 8 | 11 |
| 14 | 50 | $SO_4^{2-}$ 50<br>$Fe^{2+}$ 10 | 1.5 | 60 | 50 | 100 | 1.0 | 5 | 8 | 11 |
| 15 | 50 | $SO_4^{2-}$ 50<br>$Mn^{2+}$ 15 | 1.5 | 60 | 50 | 100 | 1.0 | 5 | 8 | 11 |
| 16 | 50 | $SO_4^{2-}$ 100<br>$NO_3^-$ 20 | 1.5 | 50 | 50 | 100 | 1.0 | 5 | 8 | 11 |
| 17 | 50 | $SO_4^{2-}$ 50<br>$Cl^-$ 20<br>$Ni^{2+}$ 20 | 1.5 | 50 | 50 | 100 | 1.0 | 5 | 7 | 10 |

TABLE 2

| | Anodic treatment | | | | | | | Resin chromate layer | | L value | | |
|---|---|---|---|---|---|---|---|---|---|---|---|---|
| | Bath composition | | | | | | | | | | | |
| | $ClO_3^-$ (g/l) | $SO_4^{2-}$ ion, co-additive (g/l) | pH | Temp. (°C.) | Current density (A/dm$^2$) | Quantity of electricity (C/dm$^2$) | Dry thickness (μm) | Cr (ppw) | After blackening | After resin chromate coating | Remarks |
| 1 | 3 | $SO_4^{2-}$ 100 | 1.5 | 50 | 50 | 50 | 1.0 | 5 | 16 | 19 | |
| 2 | 120 | $SO_4^{2-}$ 100 | 2.0 | 50 | 50 | 50 | 1.0 | 5 | 16 | 17 | |
| 3 | 50 | $SO_4^{2-}$ 100 | 0.3 | 50 | 50 | 50 | 1.0 | 5 | 9 | 15 | Substantial color variations |

TABLE 2-continued

| | Anodic treatment | | | | | | | Resin chromate layer | | L value | | |
|---|---|---|---|---|---|---|---|---|---|---|---|---|
| | Bath composition | | | | | | | | | | | |
| | $ClO_3^-$ (g/l) | $SO_4^{2-}$ ion, co-additive (g/l) | | pH | Temp. (°C.) | Current density (A/dm$^2$) | Quantity of electricity (C/dm$^2$) | Dry thickness (μm) | Cr (ppw) | After blackening | After resin chromate coating | Remarks |
| 4 | 50 | $SO_4^{2-}$ | 100 | 2.7 | 50 | 50 | 150 | 1.0 | 5 | 13 | 16 | Spark marks |
| 5 | 50 | $SO_4^{2-}$ | 100 | 1.5 | 80 | 50 | 100 | 1.0 | 5 | 13 | 16 | |
| 6 | 15 | $SO_4^{2-}$ | 100 | 1.5 | 50 | 50 | 100 | 0.2 | 5 | 9 | 13 | Substantial color variations |
| 7 | 50 | $SO_4^{2-}$ | 100 | 1.5 | 50 | 50 | 100 | 3.0 | 5 | 8 | 12 | not weldable |
| 8 | 3 | $SO_4^{2-}$<br>$Cl^-$ | 100<br>3 | 1.5 | 50 | 50 | 100 | 1.0 | 5 | 16 | 19 | |
| 9 | 3 | $SO_4^{2-}$<br>$NO_3^-$ | 100<br>3 | 1.5 | 50 | 50 | 100 | 1.0 | 5 | 16 | 19 | |
| 10 | 3 | $SO_4^{2-}$<br>$H_2O_2$ | 100<br>3 | 1.5 | 50 | 50 | 100 | 1.0 | 5 | 16 | 19 | |
| 11 | 3 | $SO_4^{2-}$<br>$Ni^{2+}$ | 100<br>3 | 1.5 | 50 | 50 | 100 | 1.0 | 5 | 16 | 19 | |
| 12 | 3 | $SO_4^{2-}$<br>$Co^{2+}$ | 100<br>3 | 1.5 | 50 | 50 | 100 | 1.0 | 5 | 16 | 19 | |
| 13 | 3 | $SO_4^{2-}$<br>$Fe^{2+}$ | 100<br>3 | 1.5 | 50 | 50 | 100 | 1.0 | 5 | 16 | 19 | |
| 14 | 3 | $SO_4^{2-}$<br>$Cl^-$<br>$Ni^{2+}$ | 100<br>1<br>2 | 1.5 | 50 | 50 | 100 | 1.0 | 5 | 16 | 19 | |
| 15 | 3 | $SO_4^{2-}$<br>$Mn^{2+}$ | 100<br>3 | 1.5 | 50 | 50 | 100 | 1.0 | 5 | 16 | 19 | |

We claim:

1. A method for preparing a blackened steel strip, comprising the steps of:

anodizing a zinc alloy-plated steel strip in a solution containing 5 to 100 g/l of chlorate ion ($ClO_3^-$) and 10 to 300 g/l of sulfate ion ($SO_4^{2-}$) at pH 0.5 to 2.5 at a temperature of 30° to 75° C. and with a quantity of electricity of 10 to 300 coulomb/dm$^2$, and forming an acrylic resin chromate layer on the anodized steel strip to a thickness of 0.3 to 2.5 μm.

2. The method of claim 1 wherein said solution contains 5 to 100 g/l in total of at least one member selected from the group consisting of $Cl^-$, $NO_3^-$, $H_2O_2$, $Ni^{2+}$, $Co^{2+}$, $Fe^{2+}$, and $Mn^{2+}$ as a co-additive.

3. The method of claim 1 wherein said solution contains 5 to 100 g/l in total of at least one member selected from the group consisting of $H_2O_2$, $Ni^{2+}$, $Co^{2+}$, $Fe^{2+}$, and $Mn^{2+}$ as a co-additive.

4. The method of claim 1 wherein said acrylic resin chromate layer contains 100 parts by weight of an acrylic resin and 2 to 10 parts by weight of chromium in the form of a chromate on a dry base.

* * * * *